US006945627B2

(12) United States Patent
Yamaguchi

(10) Patent No.: US 6,945,627 B2
(45) Date of Patent: Sep. 20, 2005

(54) INK JET RECORDING APPARATUS AND INK JET RECORDING METHOD

(75) Inventor: Nobuhito Yamaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 96 days.

(21) Appl. No.: 10/603,604

(22) Filed: Jun. 26, 2003

(65) Prior Publication Data

US 2004/0001123 A1 Jan. 1, 2004

(30) Foreign Application Priority Data

Jun. 27, 2002 (JP) ..... 2002-187844
Jun. 28, 2002 (JP) ..... 2002-190035

(51) Int. Cl.[7] ..... B41J 2/165
(52) U.S. Cl. ..... 347/27
(58) Field of Search ..... 347/9, 10, 11, 347/68

(56) References Cited

U.S. PATENT DOCUMENTS 4,350,989 A 9/1982 Sagae et al. ..... 347/9
6,357,846 B1 * 3/2002 Kitahara ..... 347/10
6,382,754 B1 * 5/2002 Morikoshi et al. ..... 347/11

FOREIGN PATENT DOCUMENTS

JP 57-061576 4/1982

* cited by examiner

*Primary Examiner*—K. Feggins
(74) *Attorney, Agent, or Firm*—Fitzpatrick, Cella, Harper & Scinto

(57) ABSTRACT

An ink jet recording apparatus, equipped with an ink jet head, comprises a device for vibrating a meniscus more than once in response to each print signal when the ink is not discharged. Further, in the apparatus, the meniscus is vibrated more than once at a repetition frequency higher than an audible frequency (20 Hz to 20 kHz) so that the ink may not be discharged. In addition, a meniscus vibration driving signal is set to a burst signal while the recording is performed.

10 Claims, 11 Drawing Sheets

INK JET RECORDING APPARATUS AND INK JET RECORDING METHOD

BACKGROUND OF THE INVENTION

1. Field of the Invention

The present invention relates to an ink jet recording apparatus and more particularly, it relates to an ink jet recording apparatus in which a meniscus formed in the vicinity of a discharge port of an ink jet head is vibrated, and a technique for preventing clogging of the discharge port.

2. Related Background Art

An ink jet recording head of on-demand type includes a plurality of nozzle openings and pressure generating chambers communicated with the respective nozzle openings and is designed so that an ink droplet is generated by expanding and contracting the pressure generating chamber in response to a recording signal. In such a recording head, since new ink is successively supplied to the nozzle opening which is conducting a recording operation, clogging of such nozzle opening almost never occurs. However, for example, in the nozzle openings, such as an upper end nozzle opening and a lower end nozzle opening, which have less chance for discharging the ink droplets and remain in an inoperative condition, the clogging is apt to occur.

Thus, there has been proposed a so-called flushing technique in which, after the recording operation is performed continuously for a predetermined time period, the recording head is returned to capping means disposed at a non-recording area, where the ink droplets are forcibly discharged from all of the nozzle openings toward a cap by applying driving signals to piezoelectric vibrating elements.

However, in a case where such a countermeasure is considered, since the recording operation is interrupted to reduce a recording speed and consume the ink, there have been proposed many techniques in which, by applying a small driving signal which does not discharge the ink droplet to the piezoelectric vibrating element provided in the pressure generating chamber communicated with the nozzle opening which does not generate the ink droplet during the recording operation, a small vibration is applied to the meniscus in the vicinity of the nozzle opening to prevent the clogging of the nozzle opening (for example, Japanese Patent Laid-open No. 57-61576 and U.S. Pat. No. 4,350,989).

According to these techniques, although the number of the flushing operations can be decreased to thereby prevent the reduction in the recording speed and consumption of the ink, there is a problem that audible noise is generated due to the small vibration.

SUMMARY OF THE INVENTION

The present invention is made in consideration of the above problem and an object of the present invention is to provide an ink jet recording apparatus which can surely prevent the clogging of a nozzle opening while reducing noise due to the small vibration To solve the above problem, a recording apparatus according to the present invention includes driving means for discharging ink from a discharge port in response to a recording signal and meniscus vibrating means for vibrating a meniscus in the vicinity of the discharge port with repetition frequency not belonging to an audible frequency range or belonging to a low frequency range, when the ink is not discharged from the discharge port.

Another construction of the recording apparatus according to the present invention includes driving means for discharging ink from a discharge port in response to a recording signal and meniscus vibrating means for vibrating a meniscus in the vicinity of the discharge port which does not discharge the ink during the recording operation, with a period smaller than a discharging period for the recording.

Further, an ink jet recording method according to the present invention comprises a step for discharging ink from a discharge port in response to a recording signal and a meniscus vibrating step for vibrating a meniscus in the vicinity of the discharge port, with repeated frequency not belonging to an audible frequency range or belonging to a low frequency range, when the ink is not discharged from the discharge port.

Further, another ink jet recording method according to the present invention comprises a step for discharging ink from a discharge port in response to a recording signal and a meniscus vibrating step for vibrating a meniscus in the vicinity of the discharge port which does not discharge the ink during the recording operation, with a period smaller than a discharging period for the recording.

With such arrangements, since the small vibration acting on the meniscus is performed by using the frequency or the period which is not audible to human beings, even when the clogging of the nozzle opening is eliminated and the ink in the vicinity of the nozzle opening is exchanged with the ink in the pressure generating chamber, the noise can be reduced.

DESCRIPTION OF THE PREFERRED EMBODIMENTS

The present invention will now be fully explained in connection with embodiments thereof illustrated in the accompanying drawings.

Figure 1:
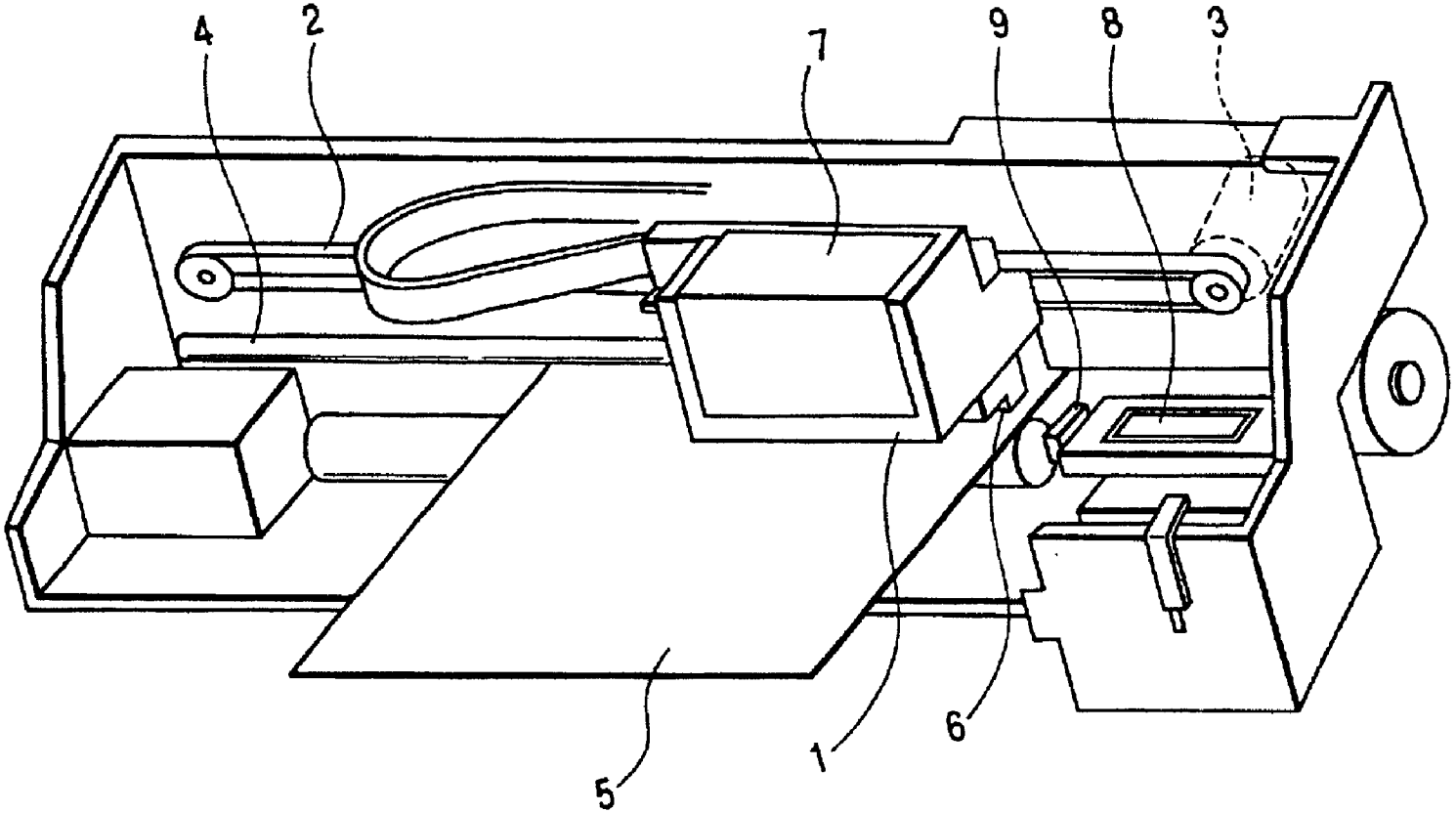
FIG. 1 is a view showing an embodiment of an ink jet recording apparatus to which the present invention is applied.

FIG. 1 shows a construction of a printer of the present invention associated with the recording. In FIG. 1, a carriage 1 is connected to a pulse motor 3 via a timing belt 2 and is reciprocally shifted in a width-wise direction of a recording paper 5 while being guided by a guide member 4.

An ink jet type recording head 6, which will be described later, is attached to a surface (lower surface in the illustrated embodiment) of the carriage which is opposed to the recording paper. The ink jet type recording head 6 serves to receive ink from an ink cartridge 7 resting on the carriage and to discharge ink droplets on the recording paper 5 synchronously with a shifting movement of the carriage 1, thereby recording an image or a character on the recording paper.

A capping device 8 is provided in a non-recording area and serves to seal nozzle openings of the recording head 6 in an inoperative condition and to receive the ink droplet from the recording head 6 in a flushing operation performed during a recording operation. Incidentally, in FIG. 1, the reference numeral 9 denotes cleaning means.

Figure 2:
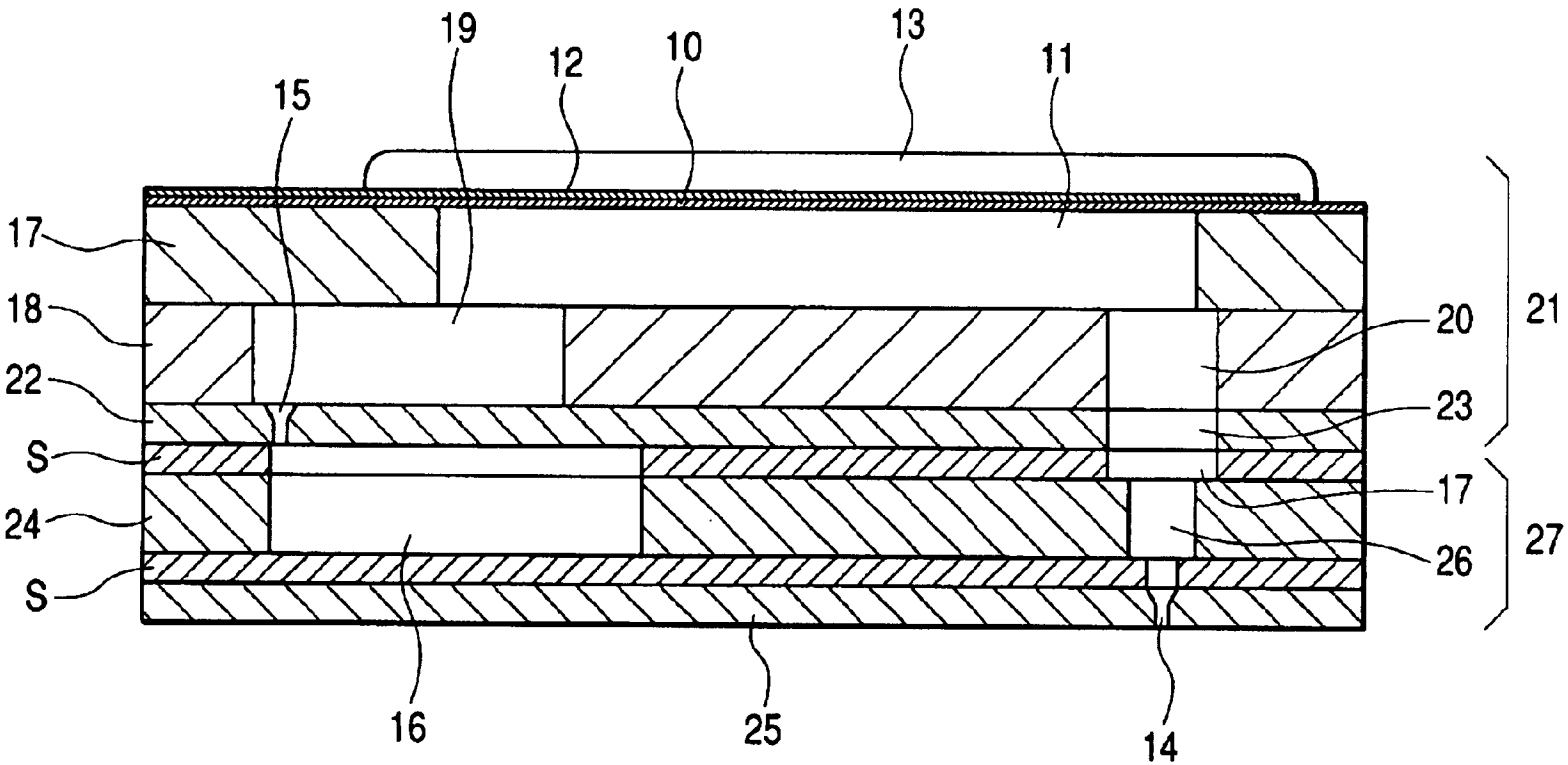
FIG. 2 is a sectional view showing the embodiment of an ink jet recording head.

FIG. 2 shows an embodiment of the recording head 6. In FIG. 2, a first lid plate 10 is formed from a thin plate made of zirconia and having a thickness of about 10 $\mu$m and, on a surface of the lid plate, driving electrodes 12 are formed to be opposed to pressure generating chambers 11, which will be described later. A piezoelectric vibrating plate 13 made of PZT or the like is formed on a surface of the corresponding driving electrode 12.

The pressure generating chamber 11 serves to be expanded and contracted by flexural vibration from the piezoelectric vibrating plate 13 to discharge the ink droplet from the nozzle opening 14 and to suck ink from a common ink chamber 16 through an ink supply port 15.

A spacer 17 is constituted by providing a through-hole in a ceramic plate made of zirconia ($ZrO^2$) and having a thickness suitable for forming the pressure generating chamber 11 (for example, 150 $\mu$m) and both surfaces of the spacer are sealed by a second lid 18 (described later) and the first lid 10, thereby forming the above-mentioned pressure generating chamber 11.

The second lid 18 is formed from a ceramic plate such as zirconia, and through the second lid 18, communication holes 19 for connecting the ink supply ports 15 to the pressure generating chambers 11, and ink discharge ports 20 for discharging the ink in the pressure generating chambers 11 toward the nozzle openings 14 are formed. The second lid is secured to the other surface of the spacer 17.

These members 10, 17 and 18 are formed by molding ceramic clay material to predetermined configurations and are laminated and then are baked to thereby form an actuator unit 21 without using any adhesive.

An ink supply port forming substrate 22 acts also as a fixing substrate for the actuator unit 21 and is formed from ceramic or metal such as non-casting steel having an ink resistive property so that a connecting member for connecting to the ink cartridge can be provided thereon.

The ink supply port forming substrate 22 is provided at its pressure generating chamber side with the ink supply ports 15 for connecting the common ink chamber 16 (described later) with the pressure generating chambers 11, and, at the other side opposite to the pressure generating chamber 11, the substrate is provided with communication holes 23 for connecting the nozzle openings 14 to the ink discharge ports 20 of the actuator unit 21.

A common ink chamber forming substrate 24 is formed from an anti-corrosion plate member, such as stainless steel, and has a thickness suitable for forming the common ink chamber 16 (for example, 150 $\mu$m), and in this substrate, a through-opening corresponding to the configuration of the common ink chamber 16 and meeting holes 26 for connecting the nozzle openings 14 of a nozzle plate 25 to the ink discharge ports 20 are formed.

Adhesive layers S comprised of heat fusing films or adhesives are interposed between the ink supply port forming substrate 22 and the common ink chamber forming substrate 24, and between the common ink chamber forming substrate 24 and the nozzle plate 25, so as to combine these members as a flow path unit 27.

The recording head is constituted by securing the actuator unit 21 onto the surface of the ink supply port forming substrate 22 of the flow path unit 27 by an adhesive.

With this arrangement, when electric charging of the piezoelectric vibrating element 13 is conducted and thus the element 13 is flexed, the pressure generating chamber 11 is contracted. As a result, the ink in the pressure generating chamber 11 is pressurized, so that the ink is discharged from the nozzle opening 14 as an ink droplet, thereby forming a dot on the recording paper.

After a predetermined time period is elapsed, when the electric discharge of the piezoelectric vibrating element 13 is conducted and thus the element 13 is returned to its original state, the pressure generating chamber 11 is expanded, with the result that the ink in the common ink chamber 16 flows into the pressure generating chamber 11 through the ink supply port 15, whereby the ink is replenished into the pressure generating chamber 11 for next recording.

On the other hand, when the piezoelectric vibrating element 13 is flexed by a small amount by charging the piezoelectric vibrating element 13 with a voltage sufficiently small that the piezoelectric vibrating element 13 does not cause the ink droplet to discharge, the pressure generating chamber 11 is also contracted. As a result, a meniscus in the vicinity of the nozzle opening 14 is pushed out toward the nozzle opening 14 by a small amount.

Then, when charges on the piezoelectric vibrating element 13 are discharged to return the piezoelectric vibrating element to its original state, the pressure generating chamber 11 is expanded by a small amount, with the result that the meniscus which was pushed toward the nozzle opening is retracted toward the pressure generating chamber 11.

In this way, by flexing the piezoelectric vibrating element 13 by the small amount and returning it to the original state at the same period as the recording timing, the meniscus in the vicinity of the nozzle opening is also vibrated by a small amount, with the result that the ink in the vicinity of the nozzle opening is replaced by the ink in the pressure generating chamber 11, thereby preventing the clogging of the nozzle opening.

Figure 3:
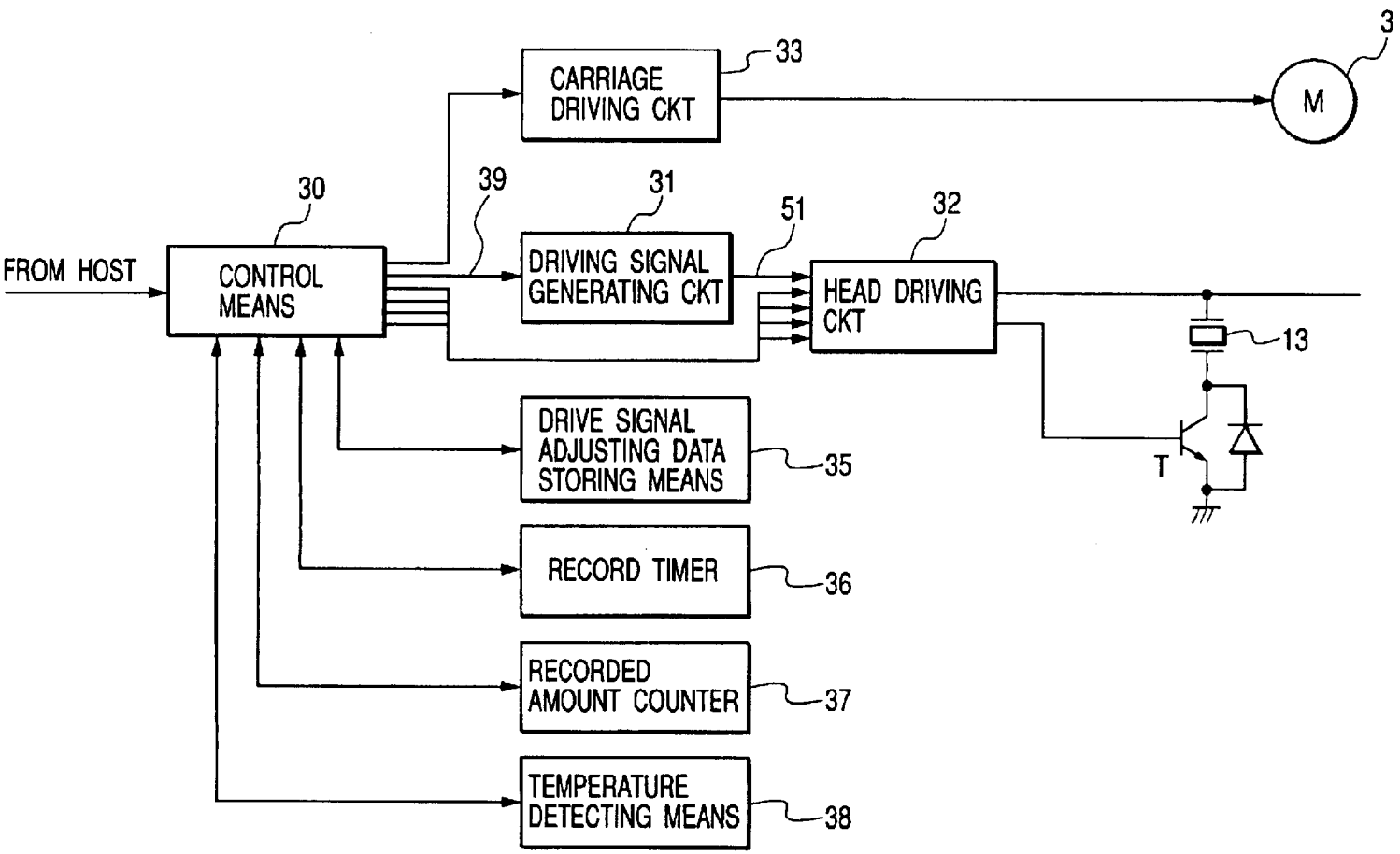
FIG. 3 is a block diagram of the apparatus according to the embodiment of the present invention.

FIG. 3 shows an embodiment of a control device for driving the recording head 6. In FIG. 3, control means serves to control a driving signal generating circuit 31, a head driving circuit 32 and a carriage driving circuit 33 (described later) in response to a recording command signal and recording data from a host to control these circuits to execute the recording operation. Further, this control device controls the flushing operation to be performed at the capping position, and controls magnitudes, applying periods and times of second and third driving signals for minutely vibrating the meniscus on the basis of count data of a record timer 36 (described later).

The driving signal generating circuit 31 is designed to generate a first trapezoidal driving signal (FIG. 4A) of a voltage value VH required for discharging the ink droplet from the nozzle opening 11. The first driving signal is set so that its continuation time T1 coincides with a natural vibration period of the pressure generating chamber 11. By doing so, it is possible to convert displacement of the piezoelectric vibrating element 13 into a movement of the meniscus effectively.

The driving circuit 32 is designed to apply a discharge driving signal (FIG. 4A) of the driving signal generating circuit 31 to the piezoelectric vibrating element 13 corresponding to the recording data, and to apply a driving signal (FIG. 4B) for the small vibration of the meniscus, the magnitude of which is about ½ of that of the discharge driving signal and adjusted to the extent that the ink is not discharged with a repetition frequency higher or lower than an audible frequency range (20 Hz to 20 kHz), in a waiting condition or before the recording operation is started. Namely, the piezoelectric vibrating element is vibrated with a frequency outside of the audible frequency range. Alternatively, the piezoelectric vibrating element is vibrated with a repetition frequency within a low frequency range (20 to 100 Hz) where an auditory sensitive property is decreased, in consideration of a loudness curve.

A driving signal adjusting data storing means 35 serves to store data for adjusting a voltage value and gradient of the driving signal in correspondence to a temperature and data for adjusting a level of the driving signal in correspondence to an ink amount consumed in the recording operation. The record timer 36 serves to count a continuation time of the recording apparatus, and it is started by the initiation of the recording operation and is reset by the flushing operation.

A recorded amount counter 37 serves to count the number of dots recorded by the recording operation, thereby detecting an ink consumed amount. Incidentally, in FIG. 3, the reference numeral 38 denotes a temperature detecting means.

Figure 5:
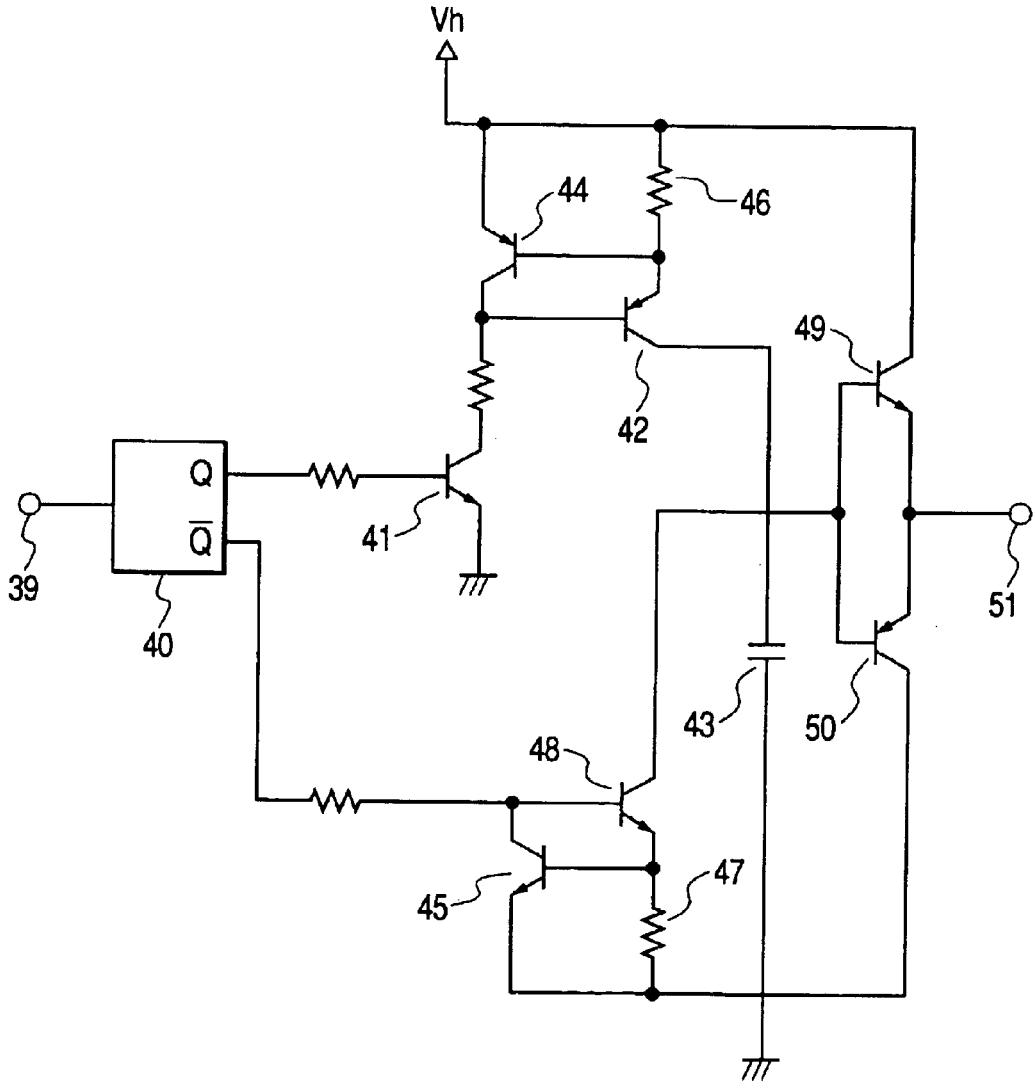
FIG. 5 is a view showing an example of a driving signal generating circuit.

FIG. 5 shows an embodiment of the driving signal generating circuit 31. In FIG. 5, a one-shot multi vibrator 40 serves to convert a timing signal from an external device into a pulse signal having a predetermined width and to output a positive signal and a negative signal from output terminals synchronously with the timing signal. One of the terminals is connected to a base of an NPN type transistor 41 to which a PNP type transistor 42 is connected so that, when the timing signal is inputted, a capacitor 43 is charged with constant (or given) electric current r until power supply voltage VH is reached.

The other terminal of the one-shot multi vibrator 40 is connected to an NPN type transistor 48 so that, at a time when the timing signal is switched, the transistor 42 is turned OFF and the transistor 48 is turned ON, thereby performing the discharging with constant (or given) electric current f until the voltage charged in the capacitor 43 is lowered to substantially zero volts.

Figure 4A:
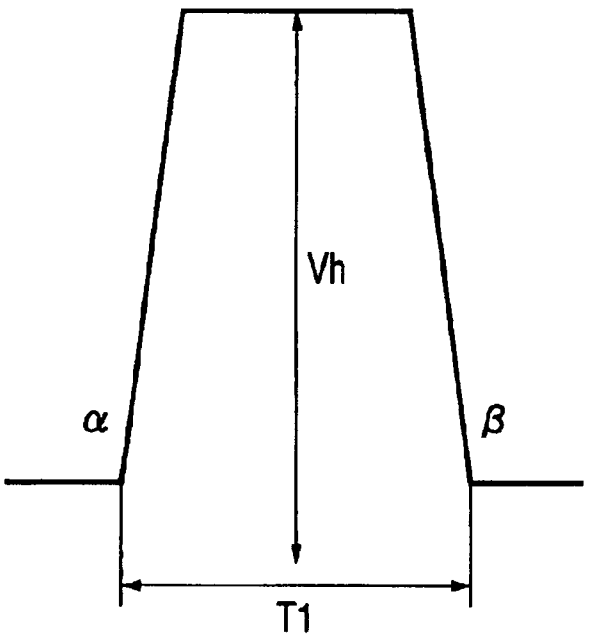
FIGS. 4A and 4B are wave form views showing a first driving signal and a second driving signal applied to a piezoelectric vibrating element, respectively.

As a result, as shown in FIG. 4A, terminal voltage of the capacitor 43 becomes a trapezoidal wave form having an area where the voltage is increased at a constant (or given) gradient $\alpha$, a saturation area where the voltage is held at the constant value and an area where the voltage is decreased at a constant (or given) gradient $\beta$, and outputs are current-amplified by transistors 49 and 50 and are outputted from a terminal 51 to the respective piezoelectric vibrating elements 13 as source driving signals.

Next, an operation of the driving signal generating circuit 31 will be explained. All of switching transistors T are turned ON for a short time by the signal from the driving circuit 32, which will be described later. As a result, although all of the piezoelectric vibrating elements 13 are subjected to the charging by the voltage from the driving signal generating circuit 31, since the pulse signal is risen-up on the way, all of the switching transistors T are turned OFF, and the charging is finished with the voltage determined by a period up to this time.

Thus, by controlling the charging time, it is possible to generate a driving signal VH/2 suitable for creating the small vibration during the stopping of the recording or during the recording operation.

Figure 4B:
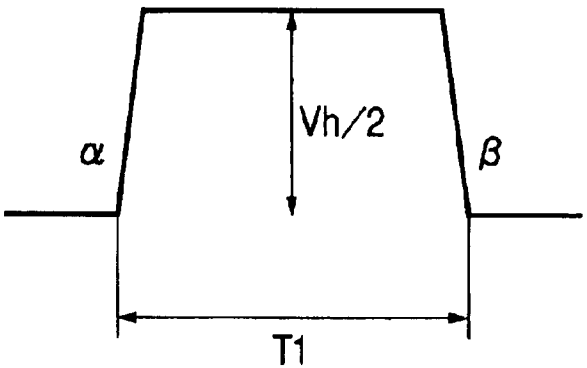

As a result, the piezoelectric vibrating element 13 generates flexion vibration, which does not eject the ink droplet from the nozzle opening 14, by applying a small voltage having the same gradient $\alpha$ as that in the recording operation as shown in FIG. 4B and being about ½ of the driving signal VH for discharging the ink droplet, with the result that the pressure generating chamber 11 is expanded and contracted minutely, thereby applying the small vibration to the meniscus in the vicinity of the nozzle opening 14.

Since the period T1 is a repetition period (frequency) outside of an audible frequency range (20 Hz to 20 kHz) or a repetition frequency range (frequency) belonging to or within a low frequency range (20 to 100 Hz), the clogging of the nozzle openings causing a non-recording condition can be prevented while reducing the noise when the small vibration is applied to the meniscus.

On the other hand, when a recording signal from the control means 30 is inputted, the transistors 42 and 48 are turned ON and turned OFF to output the trapezoidal voltage, i.e., the first driving signal. Since the switching transistors T connected to the piezoelectric vibrating element 13 by which the recording operation is to be performed are turned ON by the driving circuit 32 (described later), the charging up to the voltage VH is performed by the driving signal.

As a result, the driving signal generated in the driving signal generating circuit 31 flows into the piezoelectric vibrating element 13 so that the piezoelectric vibrating element 13 is charged with the constant (or given) electric current. Thus, the piezoelectric vibrating elements 13 which discharge the ink droplets for the recording are flexed toward the respective pressure generating chambers 11 to contract the pressure generating chambers 11, thereby discharging the ink droplets from the nozzle openings 14.

When a predetermined time period has elapsed, since the transistor 48 is turned ON to discharge the capacitor 43, with the result that the piezoelectric vibrating elements 13 are discharged to restore to their original states, the pressure generating chambers 11 are expanded, so that the ink in the common ink chamber 16 flows into the pressure generating chambers 11.

Further, when the recording head is shifted to the non-recording area, the driving signal providing small vibration of about ½ of the discharge driving signal is applied to the piezoelectric vibrating elements 13 to discharge the piezoelectric elements, thereby causing the small vibration.

Figure 6A:
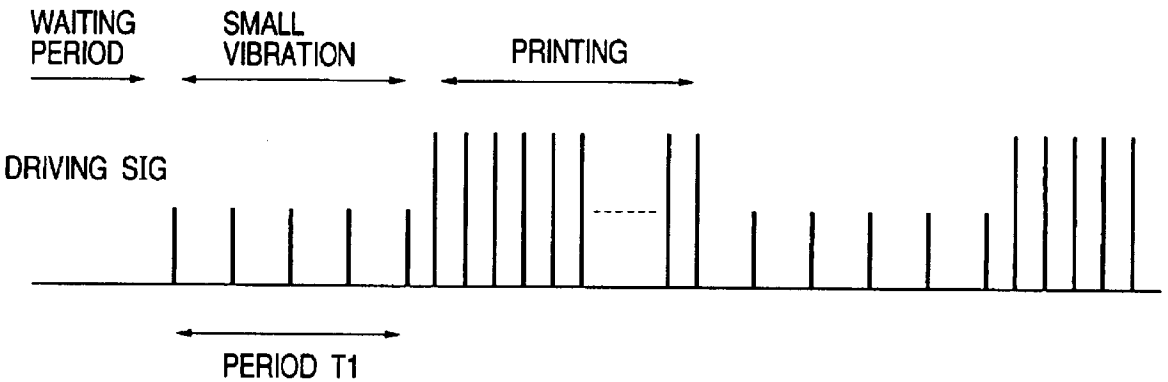
FIGS. 6A and 6B are views showing a relationship between the driving signal applied to the piezoelectric vibrating element and a shifting movement of a carriage.
Figure 6B:
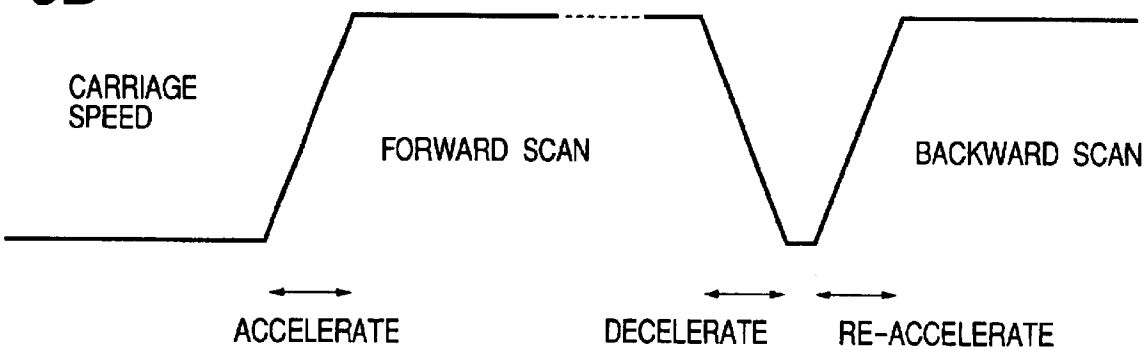

Now, the operation of the apparatus having the above-mentioned construction will be explained with reference to a timing view of FIGS. 6A and 6B. From the inoperative condition, which is a waiting condition in which the recording head 6 is not sealed by the capping device 8, when the recording signal is inputted to shift the carriage 1, the control means 30 accelerates the carriage 1 toward a recordable speed and, immediately before the recording speed is reached, executes the small vibration plural times (for example, three times or more) continuously and executes the burst with the period same as the discharging period for the recording by plural times (for example, five times or more) repeatedly. As a result, the inks in the vicinity of the nozzle openings are replaced by the inks in the pressure generating chambers 11 which are not viscosity-increased, thereby permitting the secure discharging in the recording operation.

After this, immediately before the recording operation is performed, i.e., for example, before at least one cycle when the recording signal is inputted, the output of the driving signal for the small vibration is stopped so that the driving signal generating circuit 31 can output a signal having a level required for discharging the ink. When the carriage 1 reaches the recording speed and the recording data is inputted, the record timer 36 is started and the inputting of the recording data is awaited.

In this condition, when the recording data is inputted, while the recording head 6 is being scanned by the carriage 1 in the width-wise direction of the recording paper 5, the piezoelectric vibrating element 13, by which the recording is to be performed, is flexed by the increased voltage of the first driving signal to contract the pressure generating chamber 13, thereby discharging the ink from the nozzle opening 14. At the time when the predetermined time period is elapsed, the piezoelectric vibrating element 13 is returned to its original state with the decreased voltage of the discharge driving signal to expand the pressure generating chamber 11, thereby supplying the ink from the common ink chamber 16 into the pressure generating chamber 11.

In this case, the ink droplets are not always discharged from all of the nozzle openings, but, in some nozzles, recording may not be performed for a while. In such a case, in order to prevent the clogging of such nozzles, the small signal burst is applied to such nozzles at the same timing as the discharge driving signal.

When the recording corresponding to one scan of the carriage 1 and the applying of the discharge driving signal have stopped, the recording head 6 is returned to the waiting condition again, and, thereafter, the carriage 1 is decelerated and the scanning direction is reversed and the carriage is accelerated again to start the recording operation for next scanning; meanwhile, similar to the above, the small vibration of the meniscus is performed, thereby preventing the clogging of the nozzle openings 14.

The scanning/recording cycle is repeated until the recording data from the host is ceased, thereby performing the recording.

During the recording operation, when the count of the record timer 36 reaches a predetermined time (for example, 10 seconds), the control means 30 shifts the recording head 6 to the flushing position, i.e., a position opposed to the capping device 8, where a regular flushing operation for discharging ink droplets corresponding to a predetermined number of dots (for example, several thousands of dots) is carried out. When the flushing operation is finished, the record timer 36 is reset and the counting operation is executed again and, the recording operation is started again by the above process.

Thereafter, whenever the record timer 36 counts the predetermined time, the regular flushing operation is carried out to forcibly discharge the ink from all of the nozzle openings 14, thereby preventing the clogging of the nozzle openings.

Incidentally, in the above-mentioned embodiment, there was explained an example that the level of the small vibration driving signal applied to the piezoelectric vibrating element 13 is maintained to the constant value VH/2 in order to provide the small vibration to the meniscus in the non-recording area during the inoperative condition. In a case where the ink amount discharged by the recording head 6 in the recording area and/or the ink amount discharged by the regular flushing operation is detected on the basis of data from the recorded amount counter 37, there may be such control that if the discharged ink amount is great, the voltage value of the small vibration driving signal is decreased, whereas, if the ink amount is small, the voltage value is increased within a range in which the ink droplet is not discharged. In this case, the small vibration is performed while considering the viscosity of the ink in the pressure generating chamber 11, so that clogging can be prevented positively while reducing the burden of the piezoelectric vibrating element 13 during the inoperative condition as much as possible.

The setting of the level of the small vibration driving signal corresponding to the discharged amount of the ink droplets during the recording operation can easily be realized by previously storing a relationship between the discharged amount and the voltage value in the storing means 35 and by reading out the voltage value corresponding to discharged amount data of the recorded amount counter 37.

Further, since the viscosity of the ink is greatly varied with the temperature, in a case where the meniscus is minutely vibrated by applying a signal having low voltage to the piezoelectric vibrating element 13, an amplitude value of the small vibration is greatly changed according to the temperature.

In order to solve such a problem, although it can be considered that the voltage level is adjusted, since control of the charging time is required, the circuit arrangement becomes complicated. Thus, it is designed so that the voltage value of the small vibration driving signal is maintained to a constant value (VH/2) and only the rise-up gradient and rise-down gradient are adjusted in accordance with an environmental temperature.

That is to say, regarding a room temperature (25° C.), the rise-up gradient $\alpha$ is set to 4 V/$\mu$sec. and the rise-down gradient $\beta$ is set to 6.7 V/$\mu$sec.; regarding a low temperature of 10° C., the rise-up gradient $\alpha 1$ is set to 5 V/$\mu$sec. and the rise-down gradient $\beta 1$ is set to 8.4 V/$\mu$sec.; and, regarding a high temperature, the rise-up gradient $\alpha 2$ is set to 3 V/$\mu$sec. and the rise-down gradient $\beta 2$ is set to 5 V/$\mu$sec. so that the greater the temperature the greater the flexing speed and returning speed of the piezoelectric vibrating element 13, thereby helping the movement of the ink of which viscosity is increased due to the low temperature.

The adjustment of the rise-up gradients $\alpha$, $\alpha 1$, $\alpha 2$ and the rise-down gradients $\beta$, $\beta 1$, $\beta 2$ in the various temperatures can easily be realized by previously storing data representing a relationship between the temperature and the gradients $\alpha$, $\alpha 1$ , $\alpha 2$, $\beta$, $\beta 1$, $\beta 2$ in the storing means 35 and by reading out the gradient on the basis of a temperature signal from the temperature detecting means 38.

According to the illustrated embodiment, the level of the audible sound caused due to the small vibration can be reduced to one-half, one-third or therearound, thereby reducing the noise of the recording apparatus. Further, in the above-mentioned embodiment, while an example that the releasing of the inoperative or rest condition is detected by the shifting movement of the carriage was explained, such releasing of the inoperative condition may be detected by detecting a recording signal from an external device and similar effects can be achieved.

Figure 7:
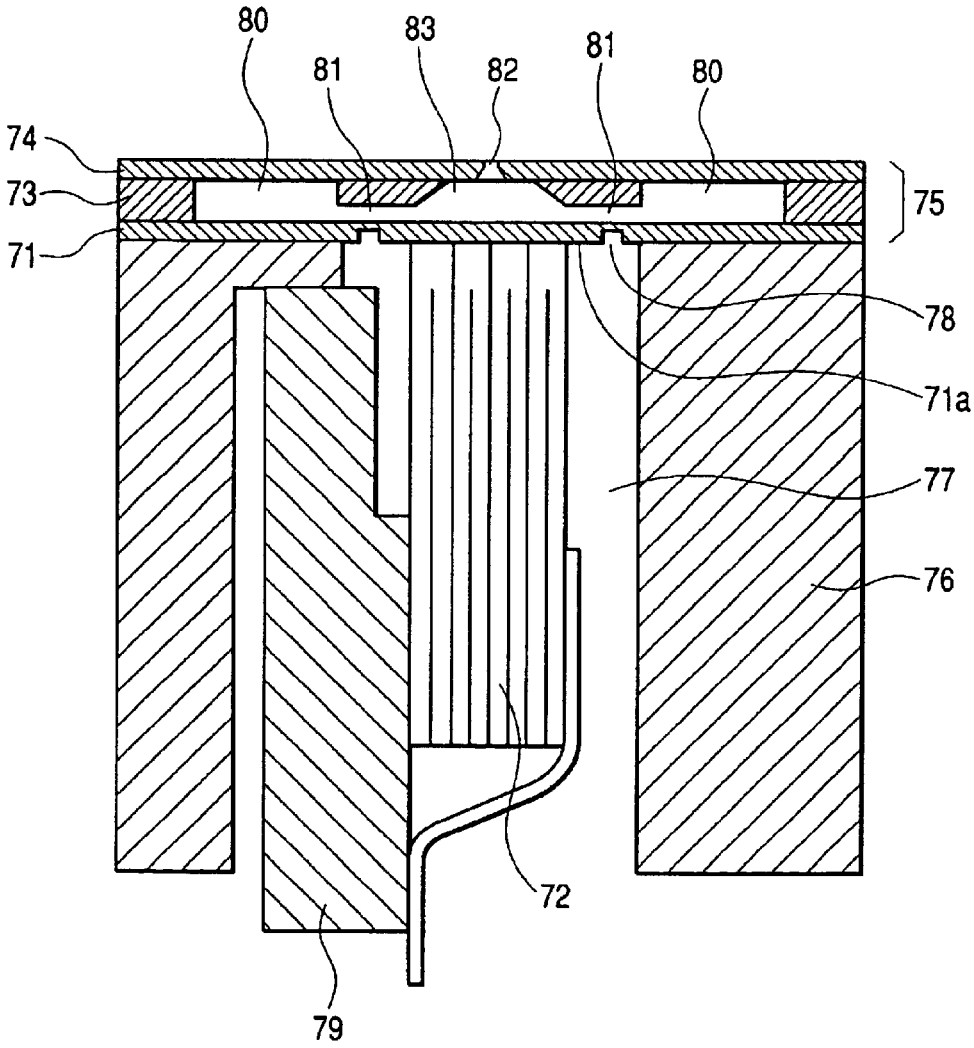
FIG. 7 is a view showing an embodiment of a recording head of another type to which the present invention can be applied.

FIG. 7 shows an embodiment of a recording head using piezoelectric vibrating elements of a longitudinal vibrating mode to which the present invention can be applied. In FIG. 7, a vibrating plate 71 is formed from a thin plate which is elastically deformed by abutting against a tip end of the piezoelectric vibrating element 72 and is secured to a nozzle plate 74 sealingly and integrally with the interposition of a flow path forming plate 73, thereby forming a flow path unit 75.

A base 76 includes a containing chamber 77 for containing the piezoelectric vibrating element 72 in a vibration enabling manner and an opening 78 for supporting the flow path unit 75 and serves to secure the flow path unit 75 so as to abut the tip end of the piezoelectric vibrating element 72 against an island portion 71*a* of the vibrating plate 71, thereby forming the recording head.

With this arrangement, when the piezoelectric vibrating element 72 is charged and contracted, a pressure generating chamber 83 is expanded. As a result, ink in common ink chambers 80 is supplied into the pressure generating chamber 83 through ink supply ports 81.

After a predetermined time period has elapsed, when the piezoelectric vibrating element 72 is discharged and is returned to its original state, the pressure generating chamber 83 is contracted to compress the ink in the pressure generating chamber 83, with the result that the ink is discharged through a nozzle opening 82 as an ink droplet, thereby forming a dot on a recording paper.

When the piezoelectric vibrating element 72 is contracted by a small amount by applying a small pulse, which does not discharge the ink droplet, to the piezoelectric vibrating element 72, since the pressure generating chamber 83 is also expanded a little, the meniscus in the vicinity of the nozzle opening 82 is retracted toward the pressure generating chamber 83. Then, when the piezoelectric vibrating element 72 is returned to its original state, the pressure generating chamber 83 is contracted to slightly push the meniscus back toward the nozzle opening 82.

In this way, by flexing the piezoelectric vibrating element 72 by the small amount at the same period as the recording timing, the meniscus in the vicinity of the nozzle opening 82 is also vibrated by a small amount, with the result that, similar to the aforementioned embodiment, the ink in the vicinity of the nozzle opening is replaced by the ink in the pressure generating chamber 83, thereby preventing the clogging of the nozzle opening.

Incidentally, in the above-mentioned embodiment, an example that, in the recording operation of the recording head, the first driving signal is applied after the third driving signal is applied was explained. But, even when the third driving signal is applied after the first driving signal is applied, similar effects can be achieved.

In the present invention, there may be provided an ink jet recording head having pressure generating chambers formed by a nozzle plate in which nozzle openings are formed and vibrating plates deformed by displacement of piezoelectric vibrating elements, a first trapezoidal driving signal for discharging an ink droplet from a nozzle opening, driving signal generating means for generating a small vibration driving signal for vibrating a meniscus to the extent that the ink droplet is not discharged from the nozzle opening, and means for selecting (1) a first mode for applying the small vibration driving signal to the piezoelectric vibrating element continuously and synchronously with a recording period in a condition that a recording head is positioned in a recording area and (2) a second mode for applying the small vibration driving signal to the piezoelectric vibrating element continuously for a time longer than an applying time in the first mode, immediately before a recording operation is started. In an inoperative condition, by vibrating the meniscus minutely for a predetermined time with a period shorter than a time which does not generate clogging of the nozzle opening, the clogging is prevented while reducing the number of vibrations of the piezoelectric vibrating element to as few as possible and reducing fatigue and noise of the piezoelectric vibrating element and, immediately before the recording operation is started, the small vibration is performed continuously to ensure positive elimination of the clogging of the nozzle opening and the positive recording operation by replacing the ink in the vicinity of the nozzle opening by the ink having low viscosity in the pressure generating chamber.

Incidentally, in the above-mentioned embodiments, while an example that the piezoelectric vibrating element is used as the recording element for discharging the ink was explained, the present invention is not limited to such an example, but a heating element for generating a bubble by applying thermal energy to the ink may be used. Further, while an example that the piezoelectric vibrating element is used as the means for vibrating the meniscus was explained, the present invention is not limited to such an example, but a heating element for generating a bubble by applying thermal energy to the ink may be used or the piezoelectric vibrating element may also act as the recording element. Further, as the means for vibrating the meniscus, means for generating deformation of the pressure generating chamber by using an electrostatic force or a small vibration adding device may be used.

Figure 8:
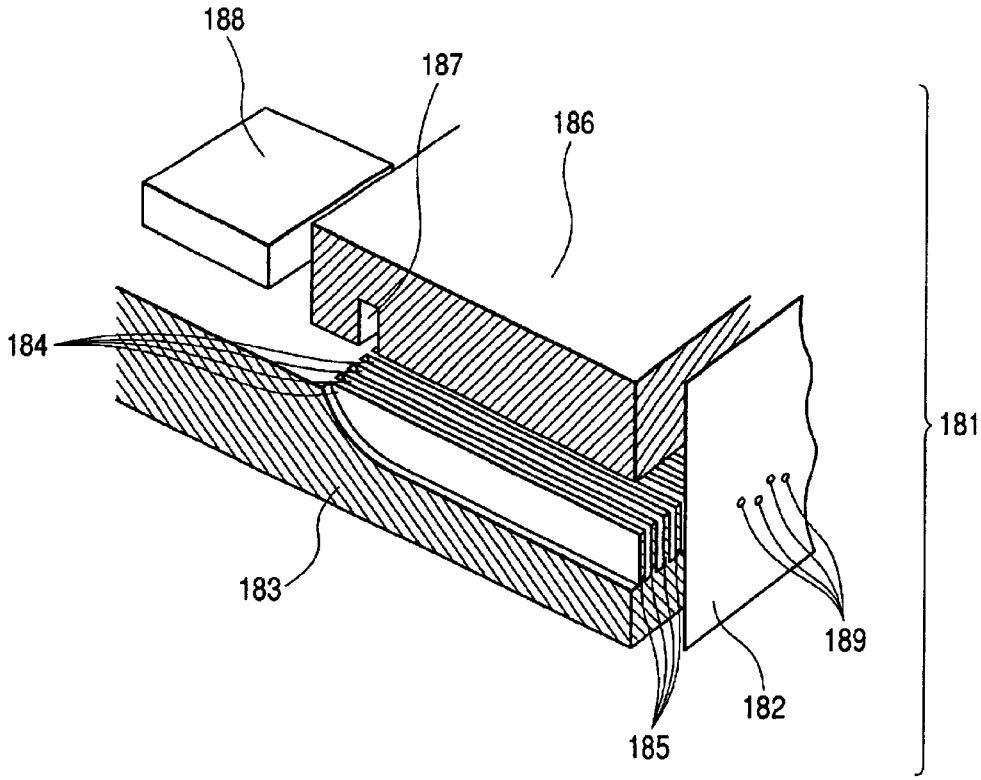
FIG. 8 is a view showing an embodiment of a recording head of another type (strain mode) to which the present invention can be applied.

FIG. 8 shows an embodiment of a recording head using a piezoelectric vibrating element of sliding deformation type to which the present invention can be applied. In FIG. 8, a print head 181 includes a bottom portion 183 extending rearwardly from a nozzle plate 182 in parallel with the latter. The bottom portion 183 is obtained by working a polarized piezoelectric material and grooves are formed in the bottom portion by scribing. Flow paths 184 corresponding to the grooves are narrow and elongated and have a rectangular cross-section and each flow path has longitudinally extending side walls 185. Each side wall 185 extends along the overall length of a flow path 184. Electrodes are formed on side surfaces of the side walls 185 by a plating process. By applying voltage to the electrodes formed on both side surfaces of a side wall 185, an electric field acts on the polarized piezoelectric material, with the result that the side wall is slide-deformed in a direction perpendicular to an axis of the flow path, whereby ink pressure in the flow path is changed so that a droplet is discharged from a nozzle. The flow paths 184 are closed by a cover 186. But they are connected to a manifold 187 as a groove formed in the cover 186, at ends remote from the nozzles, whereby they are communicated with an ink reservoir (not shown). An electric circuit (not shown) for deforming the side wall 185 is formed on a driver IC 188 on the bottom portion 183. By controlling the applying of pressure to the plurality of parallel flow paths 184 by means of the drivers IC 188, simultaneous on-demand ink discharging from the plural nozzles is achieved.

In this case, when a flow path 184 is expanded by a small amount by applying small electric current, which does not discharge the ink droplet, to the side walls 185, a meniscus in the vicinity of a nozzle opening 189 formed in the nozzle plate 182 is retracted. Then, when the voltage is returned to an original state, the meniscus is slightly pushed back toward an outlet of the nozzle opening 189.

In this way, when the side walls 185 are deformed slightly synchronously with the recording timing, since the meniscus in the vicinity of the nozzle opening 189 is also vibrated slightly, similar to the above-mentioned embodiment, the ink in the vicinity of the nozzle opening is replaced by the ink in the flow path 184, thereby preventing the clogging of the nozzle opening.

Figure 9:
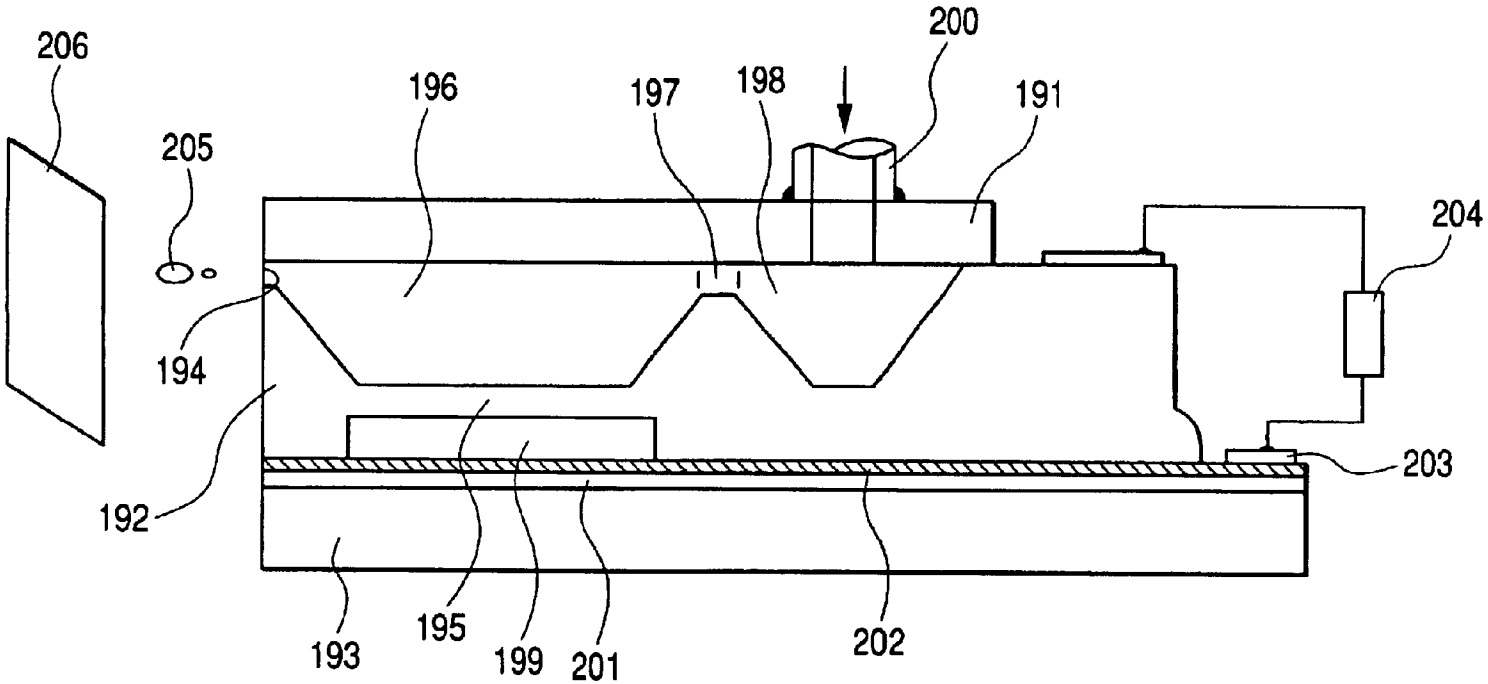
FIG. 9 is a view showing an embodiment of a recording head of another type (electrostatic force) to which the present invention can be applied.

FIG. 9 shows an embodiment of a recording head utilizing pressurization due to deformation of a pressure chamber caused by an electrostatic force, to which the present invention can be applied. In FIG. 9, an ink jet head has a laminated structure obtained by overlapping and joining three substrates 191, 192 and 193 having constructions which will be fully described hereinafter. The intermediate substrate 192 is, for example, a silicon substrate and includes a plurality of parallel and equally spaced nozzle grooves formed in a surface of the substrate 192 from one end of the substrate to form a plurality of nozzle holes 194, recessed portions constituting discharge chambers 196 communicated with the respective nozzle grooves and each having a bottom wall acting as a vibrating plate 195, narrow grooves for ink flow ports constituting orifices 197 provided at rear parts of the recessed portions, and a recess constituting a common ink cavity 198 for supplying ink to the respective discharge chambers 196. Further, the vibrating plate 195 is provided, at its lower part, with a recess constituting a vibrating chamber 199 for mounting an electrode, which will be described later. An upper substrate 191 joined to an upper surface of the intermediate substrate 192 is made of, for example, glass or plastic and, by joining this substrate 191, the nozzle holes 194, the discharge chambers 196, the orifices 197 and the ink cavity 198 are constituted. The upper substrate 191 is provided with an ink supply port communicated with the ink cavity 198. The ink supply port is connected to an ink tank (not shown) via a connection pipe 200. The lower substrate 193 joined to a lower surface of the intermediate substrate 192 is made of, for example, glass or plastic and, by joining this lower substrate 193, the vibrating chambers 199 are defined and electrodes 201 are formed on a surface of the lower substrate 193 at positions corresponding to the respective vibrating plates 195. Each electrode 201 has a lead portion 202 and a terminal portion 203. Further, except for the terminal portion 203, the entire electrode 201 and the lead portion 202 are coated by an insulation film (not shown). A lead wire is connected to each terminal portion 203 by bonding. Further, an oscillating circuit 204 is connected between the intermediate substrate 192 and the terminal portion 203 of the electrode 201. In this way, the ink jet head is constituted. The ink is supplied from the ink tank (not shown) to the interior of the intermediate substrate 192 through the ink supply port to fill the ink cavity 198, the discharge chambers 196 and the like. The reference numeral 205 denotes an ink droplet discharged from the nozzle hole 194, and 206 denotes a recording paper.

Next, an operation of this embodiment will be explained. Pulse voltage is applied to the electrode 201 by the oscillating circuit 204 and the surface of the electrode 201 is electrified with positive potential, the lower surface of the corresponding vibrating plate 195 is electrified with negative potential. Accordingly, the vibrating plate 195 is flexed downwardly by a retracting action of an electrostatic force. Then, when the electrode 201 is turned OFF, the vibrating plate 195 is restored. Accordingly, the pressure in the discharge chamber 196 is increased abruptly, with the result that the ink droplet 205 is discharged through the nozzle hole 194 toward the recording paper 206. When the vibrating plate 195 is flexed downwardly, the ink is replenished from the ink cavity 198 into the discharge chamber 196 through the orifice 197. A circuit for turning ON/OFF between 0 V and positive voltage or an AC power supply can be used as the oscillating circuit 204. In the recording operation, electric pulses to be applied to the electrodes 201 of the respective nozzle holes 194 may be controlled.

In this case, when the vibrating plate 195 is deformed by a small amount by applying a small voltage, which does not discharge the ink droplet, to the electrode 201, the meniscus in the vicinity of the nozzle hole 194 is retracted. Then, when the voltage is returned to the original state, the meniscus is slightly pushed back toward an outlet of the nozzle hole 194.

In this way, when the vibrating plate 195 is deformed by the small amount synchronously with the recording timing, since the meniscus in the vicinity of the nozzle hole 194 is also vibrated minutely, similar to the above-mentioned embodiments, the ink in the vicinity of the nozzle opening is replaced by the ink in the discharge chamber 196, thereby preventing the clogging of the nozzle opening.

Figure 10:
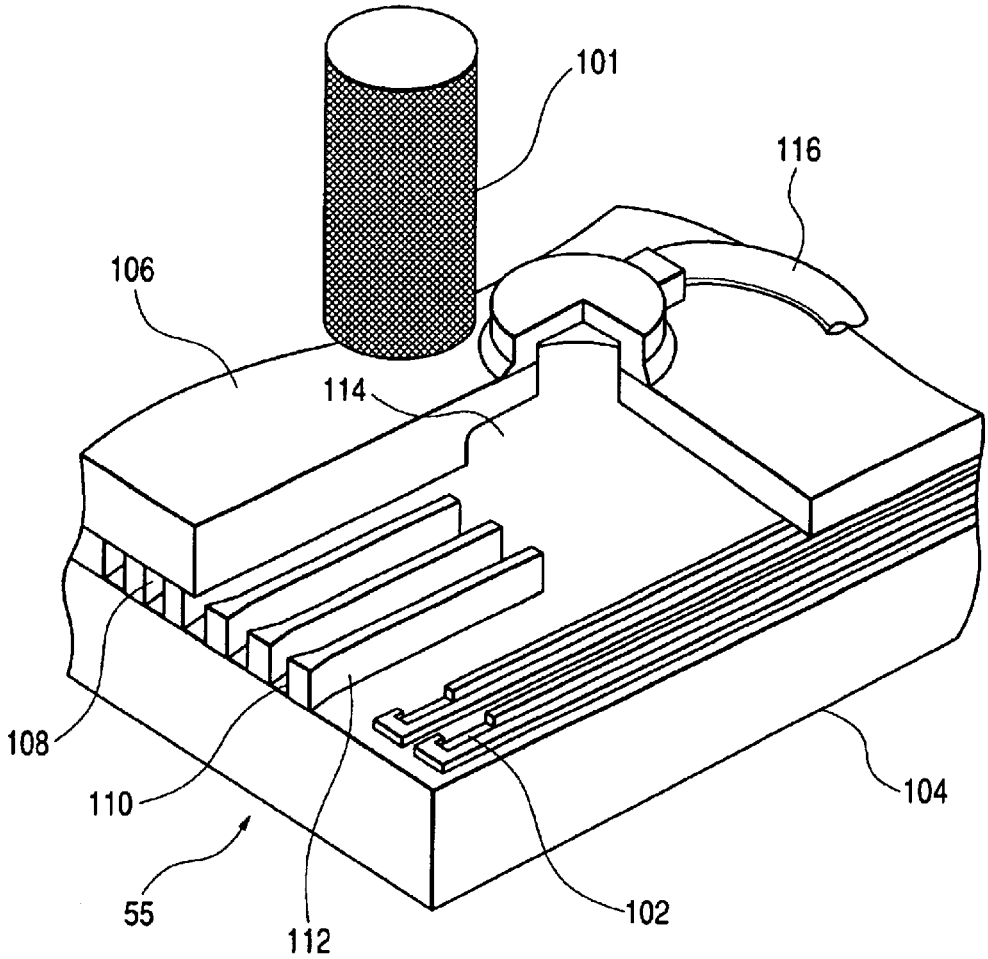
FIG. 10 is a view showing an embodiment of another type (small vibration adding device) to which the present invention can be applied.
Figure 11:
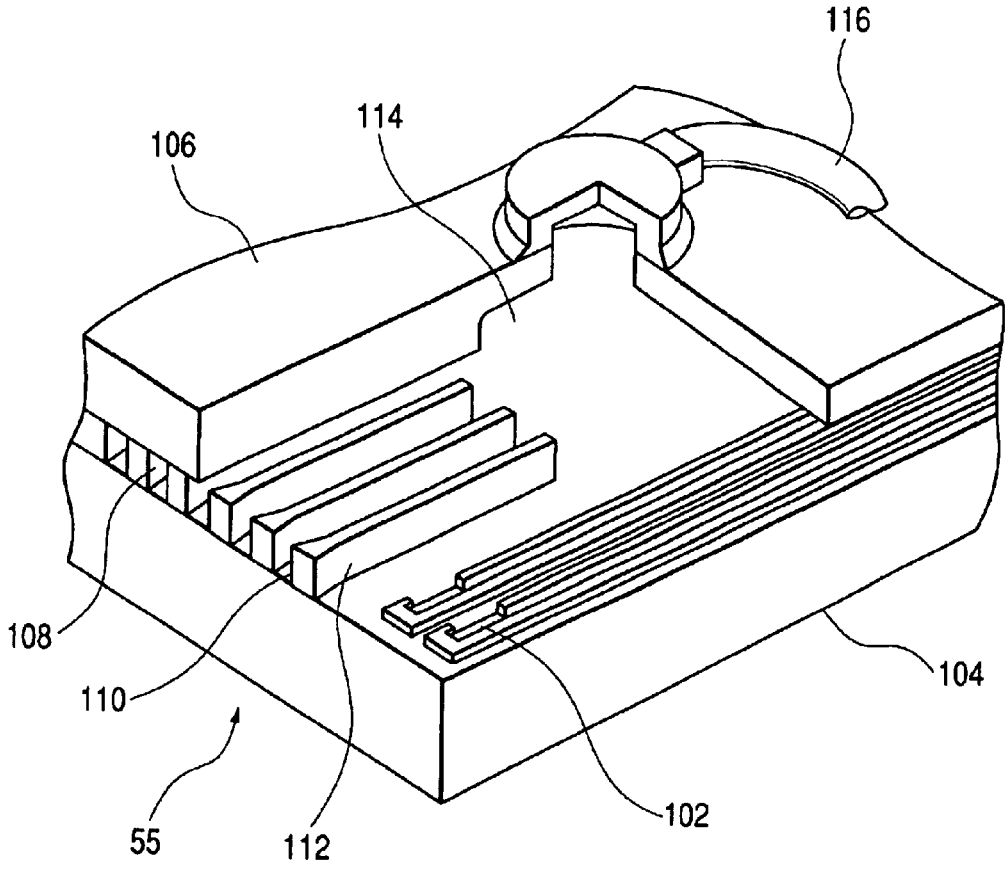
FIG. 11 is a view showing an embodiment of a recording head of another type (BJ) to which the present invention can be applied.

FIG. 10 shows an embodiment of a recording head in which the means for providing the small vibration is a vibrating adding device (or excitation device) and ink discharging means uses the pressurization by bubbling caused by a heating element, and FIG. 11 shows an embodiment of a recording head in which small vibration providing means and ink discharging means use the pressurization by bubbling caused by a heating element. In FIGS. 10 and 11, an ink jet head 55 is constituted by a heater board 104 as a substrate on which a plurality of heaters 102 for heating ink are provided, and a top plate 106 rests on the heater board 104. The top plate 106 is provided with a plurality of discharge ports (orifices) 108 and, rearwardly of the discharge ports 108, tunnel-shaped liquid paths 110 communicated with the discharge ports 108 are formed. Each liquid path 110 is isolated from the adjacent liquid paths by partition walls 112. The liquid paths 110 are commonly connected to a single ink liquid chamber 114 at their rear ends, ink is supplied into the ink liquid chamber 114 through an ink supply port 116 and the ink is supplied from the ink liquid chamber 114 to the respective liquid paths 110.

The heater board 104 and the top plate 106 are positioned so that the heaters 102 are situated at positions corresponding to the liquid paths 110, and are assembled in a condition shown in FIG. 10. In FIG. 10, although only two heaters 102 are illustrated, plural heaters 102 are provided in correspondence to the respective liquid paths 110. In an assembled condition shown in FIG. 10, when a predetermined driving pulse is supplied to a heater 102, film boiling is generated in the ink on the heater 102 to form a bubble, so that the ink is pushed and discharged out of a corresponding discharge port 108. Accordingly, it is possible to adjust the magnitude of the bubble by controlling the driving pulse applied to the heater 102 (for example, by controlling the magnitude of the electric power) and, thus, a volume of the ink discharged from the discharge port can freely be controlled.

In FIG. 10, in this case, when the ink liquid chamber 114 is expanded and contracted minutely by applying a vibration which does not discharge the ink by means of a vibration adding device (or excitation device) 101 for small vibration, the meniscus in the vicinity of the discharge port 108 is retracted and pushed back.

In this way, when the vibration adding device 101 is vibrated by the small amount synchronously with the recording timing, since the meniscus in the vicinity of the discharge port 108 is also vibrated minutely, similar to the above-mentioned embodiments, the ink in the vicinity of the nozzle openings is replaced by the ink in the liquid paths 110, thereby preventing the clogging of the nozzle openings.

In FIG. 11, in this case, when small bubbling which does not discharge the ink droplet is performed by controlling the driving pulse applied to the heater 102 (for example, by controlling the magnitude of the electric power), the meniscus in the vicinity of the discharge port 108 is pushed back and retracted.

When the small bubble is generated synchronously with the recording timing in this way, since the meniscus in the vicinity of the discharge ports 108 is also vibrated minutely, similar to the above-mentioned embodiments, the ink in the vicinity of the nozzle openings is replaced by the ink in the liquid paths 110, thereby preventing the clogging of the nozzle openings.

What is claimed is:

1. An ink jet recording apparatus for performing a recording operation by discharging ink from a discharge port of an ink jet head, comprising:

driving means for discharging the ink from the discharge port in response to a recording signal; and meniscus vibrating means for vibrating a meniscus in the vicinity of the discharge port, with a repetition frequency outside an audible frequency range or within a low frequency range, in a case where the ink is not discharged from the discharge port.

2. An ink jet recording apparatus according to claim 1, wherein the repetition frequency outside the audible frequency range is a frequency higher than 20 kHz.

3. An ink jet recording apparatus according to claim 1, wherein the repetition frequency outside the audible frequency range is a frequency lower than 20 Hz.

4. An ink jet recording apparatus according to claim 1, wherein the repetition frequency within the low frequency range is a frequency of 20 to 100 Hz.

5. An ink jet recording apparatus according to claim 1, wherein the vibration of the meniscus is applied between the recording operations for discharging the ink.

6. An ink jet recording apparatus according to claim 1, wherein said meniscus vibrating means comprises an electrostriction element.

7. An ink jet recording apparatus according to claim 1, wherein said meniscus vibrating means comprises a heating element for generating a bubble in the ink.

8. An ink jet recording apparatus according to claim 1, wherein said meniscus vibrating means comprises means for causing deformation of a pressure chamber by using an electrostatic force.

9. An ink jet recording apparatus according to claim 1, wherein said meniscus vibrating means comprises a small vibration adding device.

10. An ink jet recording method for performing a recording operation by discharging ink from a discharge port of an ink jet head, comprising:

a step for discharging the ink from the discharge port in response to a recording signal; and a meniscus vibrating step for vibrating a meniscus in the vicinity of the discharge port, with a repetition frequency outside an audible frequency range or within a low frequency range, in a case where the ink is not discharged from the discharge port.

* * * * *